US009856004B1

(12) United States Patent
Bulman

(10) Patent No.: US 9,856,004 B1
(45) Date of Patent: Jan. 2, 2018

(54) JIB FURLER HALYARD TOP FITTING ASSEMBLY

(71) Applicant: Torjak Marine Inc., Winnipeg (CA)

(72) Inventor: Michael H. Bulman, Winnipeg (CA)

(73) Assignee: Torjak Marine Inc., Winnipeg (CA)

( * ) Notice: Subject to any disclaimer, the term of this patent is extended or adjusted under 35 U.S.C. 154(b) by 0 days.

(21) Appl. No.: 15/441,629

(22) Filed: Feb. 24, 2017

(51) Int. Cl.
*B63H 9/04* (2006.01)
*B63H 9/08* (2006.01)
*B63H 9/10* (2006.01)

(52) U.S. Cl.
CPC ..... *B63H 9/1028* (2013.01); *B63H 9/04* (2013.01); *B63H 9/08* (2013.01); *B63H 9/10* (2013.01)

(58) Field of Classification Search
CPC ... B63H 9/00; B63H 9/04; B63H 9/08; B63H 9/10
USPC ..... 114/104, 105, 106, 107
See application file for complete search history.

(56) References Cited

U.S. PATENT DOCUMENTS 4,821,664 A * 4/1989 Dahmen ..... B63H 9/08 114/107
7,275,491 B1 * 10/2007 Cook ..... B63H 9/1028 114/104

* cited by examiner

*Primary Examiner* — Lars A Olson
(74) *Attorney, Agent, or Firm* — Ryan W. Dupuis; Ade & Company Inc.; Kyle R. Satterthwaite

(57) ABSTRACT

A jib furler halyard top fitting has a body for coupling to a top end of an extruded member that longitudinally receives a stay and a main portion of a halyard of a marine vessel such that the extruded member is rotatable about the stay. The body of the fitting has a passage to receive the stay. A first sheave supported on the body has a perimeter edge aligned with the main portion of the halyard extending through the extruded member. A second sheave supported on the body has a perimeter edge aligned with an end section of the halyard coupled to the top of the jib. A third sheave supported on the body has a perimeter edge including portions aligned with the first and second sheaves respectively such that the halyard remains tangential with adjacent sheaves along a length of the halyard received through the fitting.

20 Claims, 5 Drawing Sheets

JIB FURLER HALYARD TOP FITTING ASSEMBLY

FIELD OF THE INVENTION

The present invention relates to a halyard fitting assembly which receives a top portion of a halyard therethrough for use in hoisting a jib, and more particularly, the present invention relates to a halyard top fitting assembly incorporating three sheaves about which the halyard extends to allow positioning of the halyard tangentially to the sheaves along substantially a full length of the portion of the halyard that passes through the fitting assembly.

BACKGROUND

A jib furling system on a sailboat is a mechanism to roll up, or "furl" a jib either to reduce sail area or to store the jib. Typically, a furler system consist of a bottom drum, an aluminum or plastic extrusion and a top fitting. The extrusion has a variety of slots vertically that the lull of the jib slides up to secure. The line that hoists the jib is referred to as the jib halyard. The head stay or forestay, usually a wire rope, that secures the mast is located inside of the extrusion. There are, in general, two types of halyards internal to the extrusion and external.

An external halyard commonly uses the sailboat's jib halyard, from the mast, to hoist a shuttle that slides up the extrusion. The head of the jib is secured to the lower part of the shuttle. With the lower part of the jib (tack) secured to the lower drum, this tensions the sail. The problem with this design is that when the jib is furled, the shuttle has to rotate which causes the upper portion of the halyard to wrap around the top of the extrusion. This is referred to as halyard wrap. To compensate for this, many manufacturers incorporate a swivel in the top fitting.

On systems with internal halyards, the issue of halyard wrap is not a problem. The halyard rotates completely as the sail is furled. In example of FIGS. 1A and 1B, the halyard is attached to the head of the sail, goes up to and around a sheave, if present, then down through the front extrusion groove/slot. This would work fine except for the fact that the headstay is in the middle of the fitting. As such, the halyard, and sheave if present, cannot be correctly aligned with the front slot and the rear slot that locates the jib. While it may not seem significant, this can offset the top sheave 40 to 50 degrees. This due to the geometry and very little space. This offset or rotation of the sheave has a number of issues including: (i) Significant halyard and sheave wear, (ii) Increased friction, and (iii) Hoisting of the sail from an angle so as to increase the sail/extrusion friction and wear.

SUMMARY OF THE INVENTION

According to one aspect of the invention there is provided a halyard top fitting assembly for hoisting a jib assembly having (i) a stay connected at a top end of the stay to a mast of a marine vessel, (ii) an extruded member receiving the stay extending longitudinally therethrough such that the extruded member is rotatable about a longitudinal axis of the stay, (iii) a drum supported at a bottom end of the extruded member for rotation about the stay with the extruded member, (iv) a jib having a luff operatively coupled to the extruded member for longitudinal sliding relative to the extruded member, (v) a halyard having a first end coupled to a head of the jib and a main portion extending longitudinally through the extruded member, the halyard top fitting assembly comprising:

a fitting body for coupling to a top end of the extruded member for rotation with the extruded member about the stay and for receiving an intermediate portion of the halyard therethrough between the first end of the halyard and the main portion of the halyard;

a main passage extending through the fitting body for receiving the stay extending longitudinally therethrough;

a first sheave supported on the fitting body having a perimeter edge portion for alignment with the main portion of the halyard that extends through the extruded member such that the main portion of the halyard is substantially tangential to the first sheave and a section of the intermediate portion of the halyard extends partway about the first sheave;

a second sheave supported on the fitting body and having a perimeter edge portion for being offset laterally from the extruded member such that a section of intermediate portion of the halyard extends partway about the second sheave and a section of the intermediate portion of the halyard that extends between the fitting body and the head of the jib is substantially tangential to the second sheave; and a third sheave supported on the fitting body and having a perimeter edge portion in alignment with the perimeter edge portions of both the first and second sheaves so as to be arranged to support a section of the intermediate portion of the halyard extending partway about the third sheave between the first and second sheaves respectively such that:

(i) a section of the intermediate portion of the halyard that extends between the first sheave and the third sheave is substantially tangential to each of the first sheave and the third sheave, and (ii) a section of the intermediate portion of the halyard that extends between the second sheave and the third sheave is substantially tangential to each of the second sheave and the third sheave.

When stating that the sheaves are supported on the fitting body, it is understood within this document that this phrasing includes sheaves that are supported on the fitting body internally of the body, or supported on the fitting body externally of the body.

The use of three sheaves as describes above enables both ends of the halyard to be in line with the slots in the extrusion. In addition, the geometry of the sheaves is such that true sheave tangential entry and exit can be achieved. As such, the halyard can be operated so as to substantially never touch the halyard fitting itself. Friction is greatly reduced, alignment is achieved, and line pull and wear are reduced as the jib is hoisted upwardly.

The first sheave and the second sheave are preferably supported on the fitting body such that respective axes of rotation of the first sheave and the second sheave are oriented perpendicularly to the longitudinal axis of the stay.

The third sheave is preferably supported on the fitting body such that an axis of rotation of the third sheave is oriented non-perpendicularly to the longitudinal axis of the stay, for example 60 to 80 degrees relative to the longitudinal axis of the stay.

The first sheave and the second sheave are preferably supported at laterally opposing sides of the main passage for receiving the stay.

The first sheave and the third sheave are preferably each supported on the fitting body adjacent to the main passage for receiving the stay.

The third sheave is preferably spaced above the first and second sheaves.

The first sheave and the second sheave are preferably each supported on the fitting body such that the sheave is arranged to support the halyard to extend circumferentially about the sheave through a range of less than 90 degrees, and more preferably through of range of 5 degrees to 45 degrees.

The third sheave is preferably supported on the fitting body such that the third sheave is arranged to support the halyard to extend circumferentially about the third sheave through a range of greater than 90 degrees, and more preferably through a range of 120 to 200 degrees.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1B:
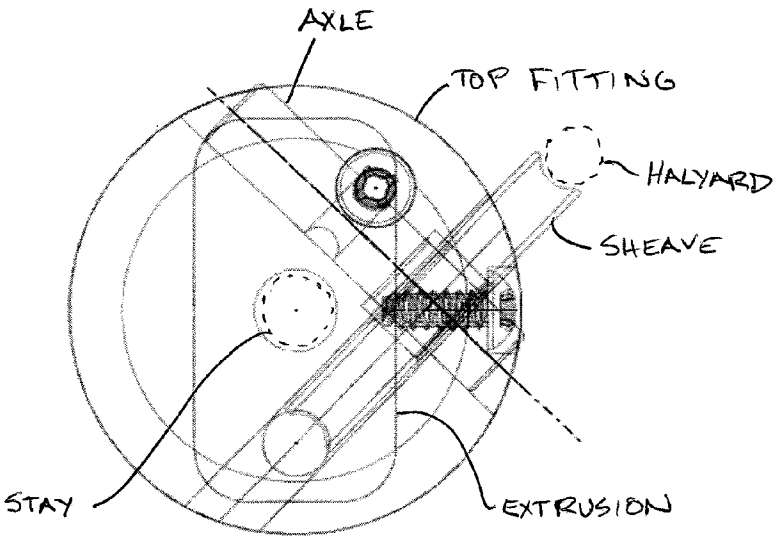
PRIOR ART FIG. 1B
FIG. 1B is a transparent top view of the prior art halyard top fitting according to FIG. 1A.
Figure 1A:
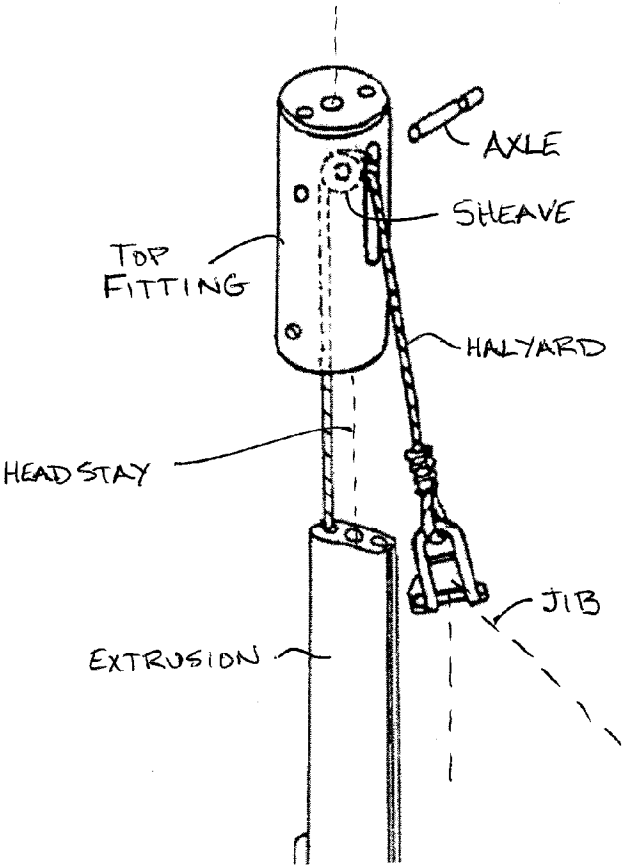
PRIOR ART FIG. 1A
FIG. 1A is an exploded perspective view of a prior art halyard top fitting for hoisting a jib assembly.

Referring to the accompanying figures there is illustrated a halyard top fitting assembly generally indicated by reference numeral 10. The halyard top fitting assembly 10 is used for hoisting a jib 12 on a marine vessel 14 as described in further detail below.

Typically, the marine vessel 14 includes a mast 16 for supporting a main sail and which is supported by a head stay 20 coupled near the top end of the mast 16 to extend downwardly and forwardly therefrom to a bottom end supported relative to the bow 22 of the vessel. In the illustrated embodiment, an extruded member 24 extends along the stay 20 so as to be rotatable relative to the stay about a longitudinally extending axis of the stay and the extruded member respectively.

The extruded member 24 as illustrated comprises a generally tubular structure which is generally rectangular or oval in cross-section and which defines a central hollow passage extending longitudinally therethrough for receiving the stay. The cross-sectional shape of the extruded member is elongated between opposing side edges. Both opposing side edges have a C-shaped channel 26 integrally formed therein. Each channel 26 has an internal portion which is generally circular in cross section and which is open along one side thereof to the exterior of the extruded member through a corresponding slot extending longitudinally along the full length of the extruded member.

A drum 28 is coupled to the bottom end of the extruded member for rotation together with the extruded member about the stay. By winding a suitable rope about the drum, the rope can be used to drive rotation of the drum and the extruded member connected therewith.

The jib 12 is provided in the form of a sail having a leading edge or luff received through the longitudinally extending slot of a respective one of the channels 26 in the extruded member. The luff of the jib includes a luff tape 32 in the form of an edge of the sail which is wrapped about a beaded member which is fixed relative to the leading edge of the jib and which is suitably sized to be received within the channel 26 so as to be retained therein by having a dimension which is greater than the width of the slot opening. The sail portion of the jib is sized to pass through the slot. The luff tape 32 remains longitudinally slidable within the C-shaped channel 26.

A halyard 34 is provided for coupling to the head of the jib at a first end 36 of the halyard for tensioning the jib. A main portion 38 of the halyard is received within the other channel 26 opposite the beaded member of the jib so as to be retained therein while being longitudinally slidable relative to the extruded member.

The halyard top fitting assembly 10 is mounted onto the top end of the extruded member 24 so as to receive the stay 20 extending therethrough and so as to be coupled to the extruded member to rotate together with the extruded member about the stay 20. An intermediate portion of the halyard between the main portion 38 received within the extruded member 24 and the first end 36 coupled to the jib is received through the halyard top fitting assembly as described in further detail below. The main portion 38 of the halyard thus exits the bottom of the halyard top fitting assembly 10 to extend longitudinally through the extruded member and exit the bottom end of the extruded member for cooperation with a conventional mechanism used to tension the halyard which in turn tensions the jib as the halyard is drawn through the top fitting assembly 10.

The top fitting assembly 10 includes a fitting body 40 formed as a one-piece, seamless, unitary construction of plastic material according to the illustrated embodiment. The fitting body may be formed in a single moulding step, or may be machined from a solid block of material to form the desired shape described herein, or yet further may be formed as a combination of moulding an initial shape followed by machining some or all of the recessed or hollow interior shapes of the body. In yet further embodiments, the body may be formed of multiple pieces which are assembled together using various joining techniques to form the collective fitting body 40.

The fitting body 40 includes a lower portion 42 having a generally cylindrical or tapered shape with an internal socket 44 formed therein which is open to the bottom of the assembly. The socket has an internal shape which matches the profile of the extruded member so as to enable the top end of the extruded member to be longitudinally slidable into the socket to form a non-rotatable connection therebetween for rotation of the top fitting assembly 10 together with the extruded member relative to the stay in the installed configuration. A socket set screw 46 is threaded radially inwardly from the exterior of the lower portion of the body in alignment with the extruded member within the socket for engaging the extruded member and retaining the fitting body mounted onto the extruded member.

The fitting body 40 further includes an upper portion above the lower portion which is enlarged in the lateral dimension relative to the lower portion so as to define a main portion 50 of the upper portion in alignment directly above the lower portion and in alignment with the extruded member therebelow, and an offset portion 52 which protrudes in a lateral direction to one side relative to the lower portion 42 and relative to the extruded member therebelow. The body is typically mounted on the extruded member such that the offset portion 52 protrudes laterally relative to the side of the extruded member locating the channel 26 that supports the beaded member of the jib 12 therein. In the illustrated embodiment according to FIGS. 4 to 10, the transition between the lower portion 42 and the upper portion 48 of the body 50 forms a shoulder which lies in a substantially common plane with the inner terminal end of the socket 44 receiving the extruded member therein in which the common plane is perpendicular to the longitudinal direction of the extruded member.

Figure 3:
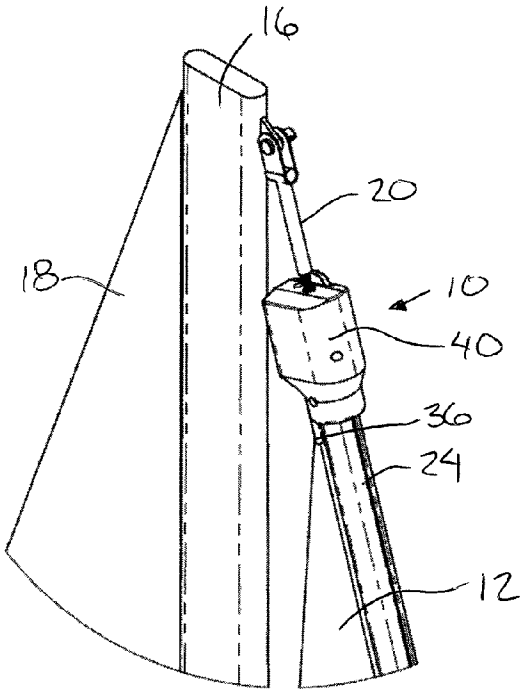
FIG. 3 is an enlarged view of a portion of the marine vessel according to FIG. 2 designated by reference character A, showing the halyard top fitting assembly.
Figure 2:
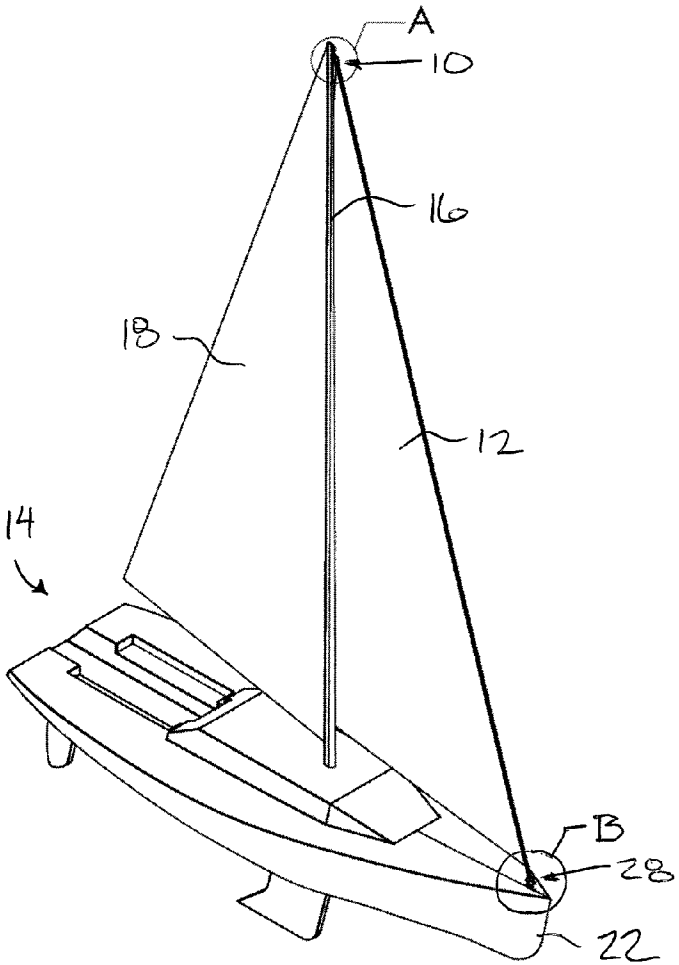
FIG. 2 is a perspective view of a marine vessel supporting the halyard top fitting assembly according to the present invention thereon.
Figure 5:
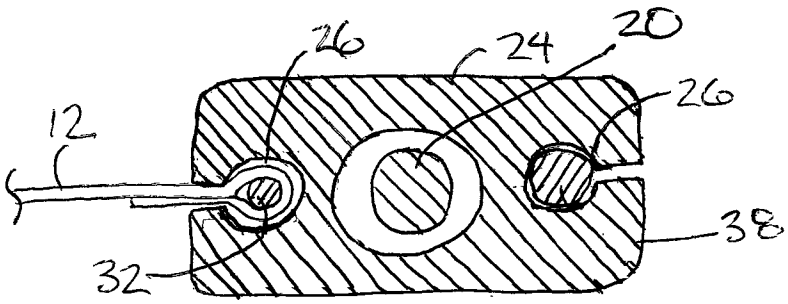
FIG. 5 is a sectional view along the line 5-5 in FIG. 4.
Figure 4:
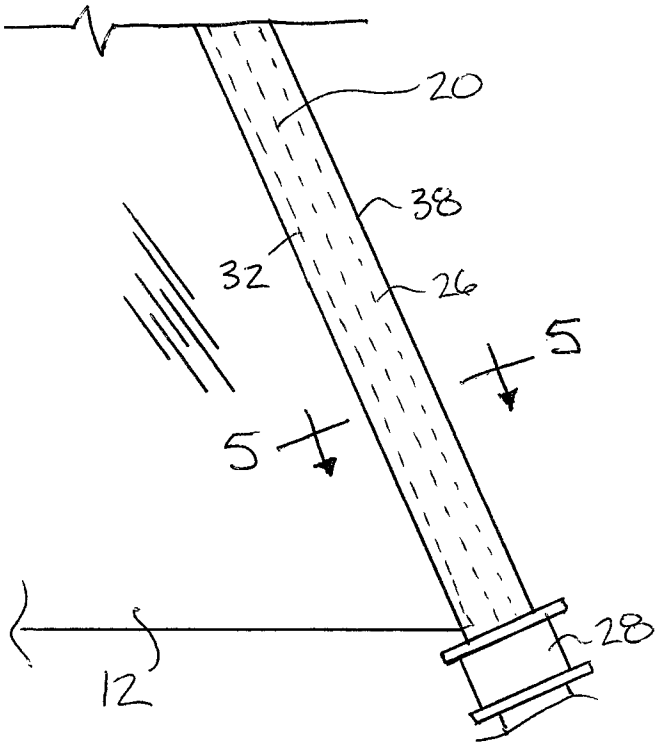
FIG. 4 is an enlarged view of a portion of the marine vessel according to FIG. 2 designated by reference character B.
Figure 7:
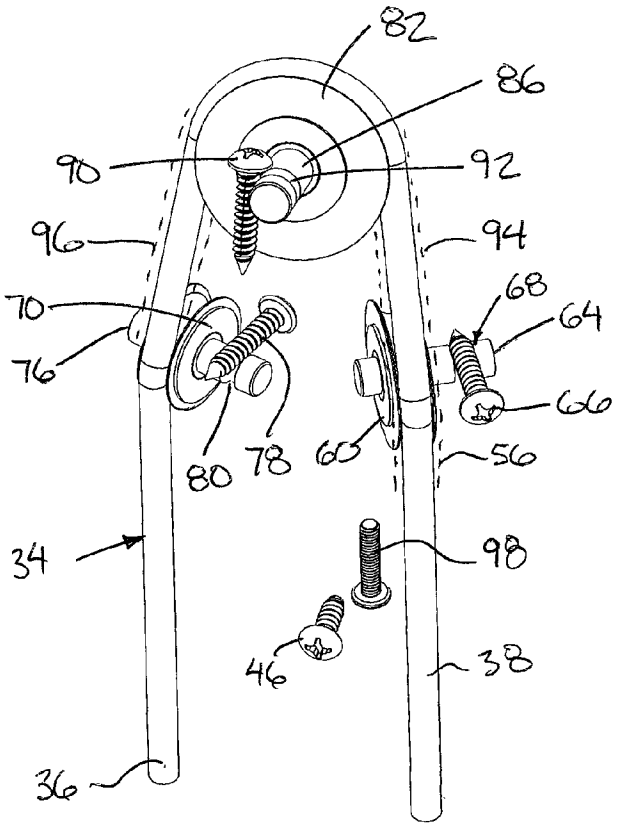
FIG. 7 is a perspective view identical to FIG. 6, but with the fitting body shown removed for illustrative purposes.
Figure 6:
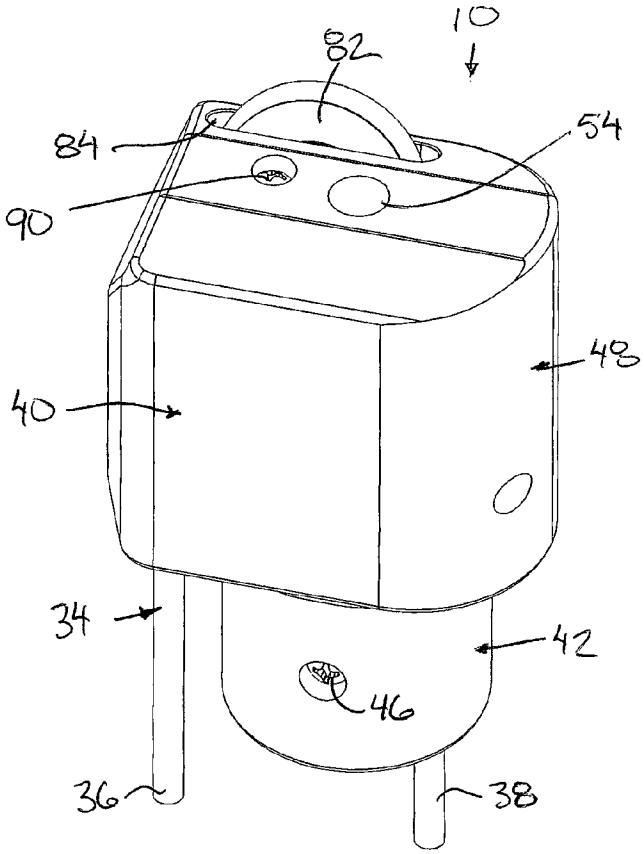
FIG. 6 is a perspective view of a top side of the halyard top fitting assembly shown separated from the marine vessel in relation to a portion of the halyard.
Figure 10:
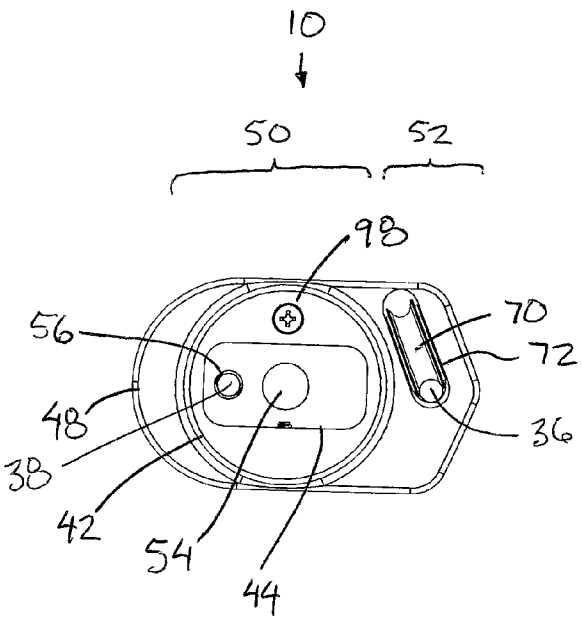
FIG. 10 is a bottom plan view of the halyard top fitting assembly.
Figure 9:
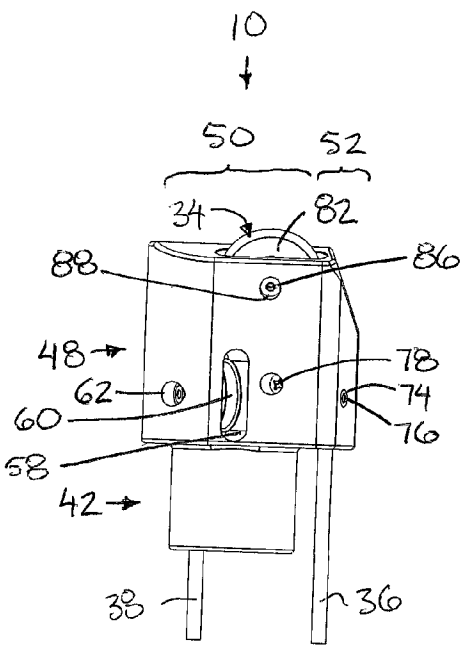
FIG. 9 is an elevational view of the halyard top fitting assembly.
Figure 8:
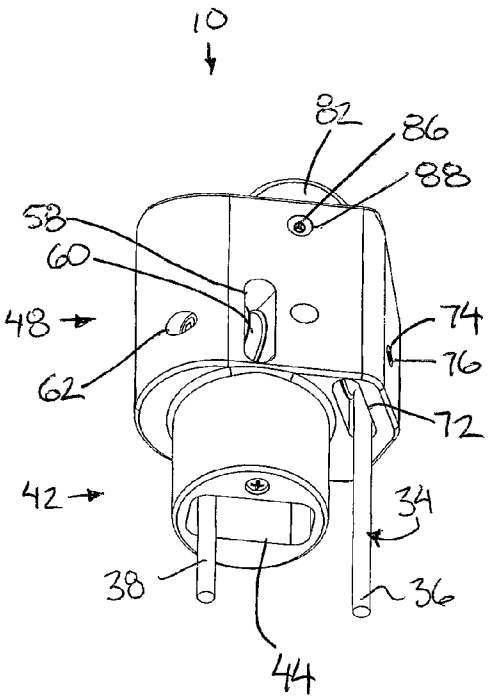
FIG. 8 is a perspective view of a bottom side of the halyard top fitting assembly.

When the lower portion is tapered, outer dimension of the fitting body is gradually reduced by a tapered surface from the larger dimension of the upper portion to the smaller dimension of the lower portion, for example as shown in FIG. 3.

The fitting body 40 includes a main passage 54 extending longitudinally therethrough as a bore connecting between the internal terminal end of the socket 44 and the external top end of the body 40. The bore extends linearly through the body 40 in the longitudinal direction of the stay for receiving the stay therethrough. The longitudinal axis of the main passage 54 aligns with the longitudinal axis of the socket 44 and the longitudinal axis of the extruded member received within the socket.

The fitting body 40 includes a first halyard passage 56 formed therein as a bore which extends linearly upward from the internal terminal end of the socket 44 at a location parallel and spaced apart from the main passage 54 so as to be aligned with the longitudinal passage of the channel 26 in the extruded member opposite the jib which receives the main portion of the halyard extending longitudinally therethrough. The first halyard passage extends only partway into the body upwardly from the internal terminal end of the socket 44 to receive a section of the intermediate portion of the halyard therethrough in use.

A first mounting slot 58 is formed to extend into the body within the main portion 50 of the upper portion 48 of the body from an external opening in the body for receiving a first sheave 60 therein which is mounted within the body such that an arcuate portion of the perimeter edge of the first sheave is aligned with the section of the halyard received in the first halyard passage 56 therebelow. More particularly the first halyard passage 56 is oriented tangentially with said portion of the perimeter edge of the first sheave 60.

To support the first sheave 60 within the body, a first axle bore 62 is formed in the upper portion of the body at the axis of the first sheave which is open to the exterior of the body to slidably receive a first axle 64 axially therein into a mounted position fully received within the body and supporting the first sheave rotatably thereon. A first retainer screws 66 is threaded into the body from the exterior thereof in alignment with a retainer groove 68 on the first axle to retain the first axle in a mounted position within the first axle bores 62 with the first sheave rotatably supported on the first axle.

The body also supports a second sheave 70 therein within the offset portion 52 of the upper portion of the body 40. The second sheave 70 is supported in a substantially identical manner to the first sheave by providing a second mounting slot 72 formed in the body which is open to the exterior through a bottom face of the offset portion of the upper portion of the body at a location forming a shoulder in the exterior surface of the body between the upper portion 48 and the lower portion 42. In order to assemble the second sheave into the body, the second sheave is slidably inserted through the second mounting slot into its mounted position before subsequent insertion of a second axle therein which supports the second sheave relative to the body similar to the manner of supporting the first sheave. A second axle bore 74 is also formed into the body to be open to the exterior for receiving the corresponding second axle 76 axially slidable therein. A second retainer screw 78 is threaded from the exterior into the body in alignment with a corresponding retainer groove 80 in the second axle to prevent slidable withdrawal of the second axle from the body. In the mounted position, bearings about the inner circumference of the second sheave rotatably support the second sheave on the axle.

Similarly to the first sheave, the second sheave 70 also comprises a pulley wheel having a peripheral groove formed therein suitably shaped and sized to receive a section of the halyard extending partway about the circumference of the second sheave in operation. The second sheave is oriented such that the axis of rotation thereof lies perpendicularly to the longitudinal axis of the top fitting assembly, the stay, and the extruded member in a common plane with the axis of rotation of the first sheave such that the common plane of the two axes is perpendicular to the longitudinal axis and the first and second sheaves are supported at laterally opposing sides of the main passage received therebetween. Furthermore, the axis of rotation of the second sheave is oriented non-perpendicularly relative to a vertical plane containing the main passage and the first halyard passage therein.

The second sheave 70 is located within the offset portion protruding laterally outward relative to the lower portion of the body such that an arcuate portion of the perimeter edge of the second sheave can be aligned along a common longitudinal axis with a connection of the first end of the halyard to the jib wherein said common longitudinal axis is parallel to the longitudinal axis of the stay and tangential to the second sheave so that a section of the halyard extending between the periphery of the second sheave 70 and the connection to the jib protrudes out of the body 40 through the second mounting slot 72 and that said section of the halyard is also tangential to the second sheave.

The body 40 also supports a third sheave 82 therein which is supported at a location fully spaced above the first and second sheaves, 60 and 70, and at a location which is positioned laterally between the first and second sheaves in close proximity and directly adjacent to the main passage also located laterally between the first and second sheaves. The third sheave is supported for rotation about an axis of rotation which is generally sloped within a range of 60 to 80 degrees relative to the longitudinal axis of the main passage through the top fitting assembly and the stay received therein. Furthermore, the axis of rotation of the third sheave lies in a longitudinally oriented plane which is generally perpendicular to the lateral direction of the fitting body 40 as well as being perpendicular to the common plane locating the main passage 54 and the first halyard passage 56 therein.

The third sheave 82 is supported within the body 40 similarly to the first and second sheaves by use of a third mounting slot 84 which receives the third sheave 82 slidably inserted into the body, in which the third mounting slot 84 is open to the exterior of the body through the top end of the body. A third axle 86 is slidably inserted axially into a third axle bore 88 formed in the body which is open to the exterior of the body through an upright side wall of the body. A third retainer screw 90 is threaded from the exterior of the body into the body for alignment with a corresponding retainer groove 92 in the third axle to prevent slidable withdrawal of the second axle from the body. In the mounted position, bearings about the inner circumference of the third sheave rotatably support the third sheave on the corresponding axle.

The third sheave 82 also comprises a pulley wheel having a peripheral groove formed therein which is suitably shaped and sized to receive a section of the halyard extending partway about the circumference of the third sheave in operation. The third sheave is oriented and positioned relative to the first and second sheaves such that an arcuate portion of the perimeter edge of the third sheave is aligned tangentially with said arcuate portions of the corresponding perimeter edges of the first and second sheaves.

Each of the axles is provided with an outer end having an internally threaded bore therein. A removal screw 98 is threaded into a respective internally threaded bore the bottom end of the fitting body which mates with the threaded bores of each of the axles. In this manner, when it is desirable to slidably remove the axles for removal of the sheaves from the fitting body, the removal screw 98 can be unthreaded from its stored position in the fitting body for sequentially threading into the bore at the end of each axle to assisting in pulling each axle out of the fitting body.

The body further includes a second halyard passage 94 formed therein from the internal terminal end of the third mounting slot 84 for connection between a perimeter location of the third sheave and a perimeter location of the first sheave. Similarly, a third halyard passage 96 is formed in the body from the internal terminal end of the third mounting slot 84 for connection between a perimeter location of the third sheave and a perimeter location of the second sheave.

With the halyard top fitting assembly 10 configured as described above, an intermediate portion of the halyard is threaded through the top fitting assembly such that the intermediate portion of the halyard generally includes the following sections:

(i) A first section of the halyard which is closest to the main portion of the halyard and which is received within the first halyard passage 56 from the main portion of the halyard received through the extruded member to a peripheral portion of the first sheave so as to be oriented tangentially to the first sheave.

(ii) A second section of the halyard extending from the first section which extends circumferentially about a portion of the periphery of the first sheave, for example through a range of 5 to 45 degrees.

(iii) A third section of the halyard extending from the second section which is received within the second halyard passage 94 to communicate between the first sheave and the third sheave while being oriented tangentially to both the first and third sheaves.

(iv) A fourth section of the halyard extending from the third section which is oriented to circumferentially partway about the third sheave, for example through a range of 120 to 200 degrees.

(v) A fifth section of the halyard extending from the fourth section which is received within the third halyard passage 96 to communicate from the third sheave to the second sheave while being oriented tangentially relative to both the second and third sheaves.

(vi) A sixth section of the halyard extending from the fifth section which is received within the body to extend circumferentially partway about the second sheave, for example through a range of 5 to 45 degrees.

(vii) A seventh section of the halyard extending from the sixth section which is received within the third mounting slot 84 to communicate from the second sheave to the first end 36 of the halyard connected to the jib while being oriented tangentially to the second sheave and parallel to the longitudinal axis of the stay.

In this manner, letting out the halyard to lower the jib or pulling downward on the main portion of the halyard for tensioning the jib results in the intermediate portion of the halyard received through the top fitting assembly being directed about the first, second and third sheaves in a manner that introduces minimal friction to the halyard, and thus minimal wear due to a minimum or substantially no contact between the halyard and the body 40 of the fitting assembly.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A halyard top fitting assembly for hoisting a jib assembly having (i) a stay connected at a top end of the stay to a mast of a marine vessel, (ii) an extruded member receiving the stay extending longitudinally therethrough such that the extruded member is rotatable about a longitudinal axis of the stay, (iii) a drum supported at a bottom end of the extruded member for rotation about the stay with the extruded member, (iv) a jib having a luff operatively coupled to the extruded member for longitudinal sliding relative to the extruded member, (v) a halyard having a first end coupled to a head of the jib and a main portion extending longitudinally through the extruded member, the halyard top fitting assembly comprising:

a fitting body for coupling to a top end of the extruded member for rotation with the extruded member about the stay and for receiving an intermediate portion of the halyard therethrough between the first end of the halyard and the main portion of the halyard;

a main passage extending through the fitting body for receiving the stay extending longitudinally therethrough;

a first sheave supported on the fitting body having a perimeter edge portion for alignment with the main portion of the halyard that extends through the extruded member such that the main portion of the halyard is substantially tangential to the first sheave and a section of the intermediate portion of the halyard extends partway about the first sheave;

a second sheave supported on the fitting body and having a perimeter edge portion for being offset laterally from the extruded member such that a section of intermediate portion of the halyard extends partway about the second sheave and a section of the intermediate portion of the halyard that extends between the fitting body and the head of the jib is substantially tangential to the second sheave; and a third sheave supported on the fitting body and having a perimeter edge portion in alignment with the perimeter edge portions of both the first and second sheaves so as to be arranged to support a section of the intermediate portion of the halyard extending partway about the third sheave between the first and second sheaves respectively such that:

(i) a section of the intermediate portion of the halyard that extends between the first sheave and the third sheave is substantially tangential to each of the first sheave and the third sheave, and (ii) a section of the intermediate portion of the halyard that extends between the second sheave and the third sheave is substantially tangential to each of the second sheave and the third sheave.

2. The halyard top fitting assembly according to claim 1 wherein the first sheave and the second sheave are supported on the fitting body such that respective axes of rotation of the first sheave and the second sheave are oriented perpendicularly to the longitudinal axis of the stay.

3. The halyard top fitting assembly according to claim 1 wherein the third sheave is supported on the fitting body such that an axis of rotation of the third sheave is oriented non-perpendicularly to the longitudinal axis of the stay.

4. The halyard top fitting assembly according to claim 1 wherein the first sheave and the second sheave are supported at laterally opposing sides of the main passage for receiving the stay.

5. The halyard top fitting assembly according to claim 1 wherein the first sheave is supported on the fitting body adjacent to the main passage for receiving the stay.

6. The halyard top fitting assembly according to claim 1 wherein the third sheave is supported on the fitting body adjacent to the main passage for receiving the stay.

7. The halyard top fitting assembly according to claim 1 wherein the third sheave is spaced above the first and second sheaves.

8. The halyard top fitting assembly according to claim 1 wherein the first sheave is supported on the fitting body such that the first sheave is arranged to support the halyard to extend circumferentially about the first sheave through a range of less than 90 degrees.

9. The halyard top fitting assembly according to claim 1 wherein the second sheave is supported on the fitting body such that the second sheave is arranged to support the halyard to extend circumferentially about the second sheave through a range of less than 90 degrees.

10. The halyard top fitting assembly according to claim 1 wherein the third sheave is supported on the fitting body such that the third sheave is arranged to support the halyard to extend circumferentially about the third sheave through a range of greater than 90 degrees.

11. A jib assembly comprising:

a stay connected at a top end of the stay to a mast of a marine vessel;

an extruded member receiving the stay extending longitudinally therethrough such that the extruded member is rotatable about a longitudinal axis of the stay;

a drum supported at a bottom end of the extruded member for rotation about the stay with the extruded member;

a jib having a lull operatively coupled to the extruded member for longitudinal sliding relative to the extruded member;

a halyard having a first end coupled to a head of the jib and a main portion extending longitudinally through the extended member;

a halyard top fitting assembly comprising:

a fitting body for coupling to a top end of the extruded member for rotation with the extruded member about the stay and for receiving an intermediate portion of the halyard therethrough between the first end of the halyard and the main portion of the halyard;

a main passage extending through the fitting body for receiving the stay extending longitudinally therethrough;

a first sheave supported on the fitting body having a perimeter edge portion for alignment with the main portion of the halyard that extends through the extruded member such that the main portion of the halyard is substantially tangential to the first sheave and a section of the intermediate portion of the halyard extends partway about the first sheave;

a second sheave supported on the fitting body and having a perimeter edge portion for being offset laterally from the extruded member such that a section of intermediate portion of the halyard extends partway about the second sheave and a section of the intermediate portion of the halyard that extends between the fitting body and the head of the jib is substantially tangential to the second sheave; and a third sheave supported on the fitting body and having a perimeter edge portion in alignment with the perimeter edge portions of both the first and second sheaves so as to be arranged to support a section of the intermediate portion of the halyard extending partway about the third sheave between the first and second sheaves respectively such that (i) a section of the intermediate portion of the halyard that extends between the first sheave and the third sheave is substantially tangential to each of the first sheave and the third sheave, and (ii) a section of the intermediate portion of the halyard that extends between the second sheave and the third sheave is substantially tangential to each of the second sheave and the third sheave.

12. The jib assembly according to claim 11 wherein the first sheave and the second sheave are supported on the fitting body such that respective axes of rotation of the first sheave and the second sheave are oriented perpendicularly to the longitudinal axis of the stay.

13. The jib assembly according to claim 11 wherein the third sheave is supported on the fitting body such that an axis of rotation of the third sheave is oriented non-perpendicularly to the longitudinal axis of the stay.

14. The jib according to claim 11 wherein the first sheave and the second sheave are supported at laterally opposing sides of the main passage for receiving the stay.

15. The jib assembly according to claim 11 wherein the first sheave is supported on the fitting body adjacent to the main passage for receiving the stay.

16. The jib assembly according to claim 11 wherein the third sheave is supported on the fitting body adjacent to the main passage for receiving the stay.

17. The jib assembly according to claim 11 wherein the third sheave is spaced above the first and second sheaves.

18. The jib assembly according to claim 11 wherein the first sheave is supported on the fitting body such that the first sheave is arranged to support the halyard to extend circumferentially about the first sheave through a range of less than 90 degrees.

19. The jib assembly according to claim 11 wherein the second sheave is supported on the fitting body such that the second sheave is arranged to support the halyard to extend circumferentially about the second sheave through a range of less than 90 degrees.

20. The jib assembly according to claim 11 wherein the third sheave is supported on the fitting body such that the third sheave is arranged to support the halyard to extend circumferentially about the third sheave through a range of greater than 90 degrees.

* * * * *